United States Patent [19]

Mukoh et al.

[11] 4,156,034

[45] May 22, 1979

[54] LIQUID DEVELOPER FOR ELECTRO PHOTOGRAPHY

[75] Inventors: Akio Mukoh; Yasuki Mori; Hirosada Morishita; Nobuhiko Shito; Shigeyoshi Tanaka, all of Hitachi, Japan

[73] Assignees: Hitachi, Ltd.; Hitachi Chemical Company, Ltd., both of Japan

[21] Appl. No.: 559,520

[22] Filed: Mar. 18, 1975

[30] Foreign Application Priority Data

Mar. 20, 1974 [JP] Japan ..... 49/30948
Mar. 20, 1974 [JP] Japan ..... 49/30949

[51] Int. Cl.[2] ..... G03G 9/16

[52] U.S. Cl. ..... 427/15; 96/1 LY; 252/62.1 L; 526/317; 526/320

[58] Field of Search ..... 252/62.1 L; 260/85.5, 260/86.7, 47 UA; 96/1 LY; 427/15; 526/317, 320

[56] References Cited

U.S. PATENT DOCUMENTS

| | | | |
|---|---|---|---|
| 3,317,483 | 5/1967 | Verdol | 260/79.7 |
| 3,369,003 | 2/1968 | Verdol | 260/85.7 |
| 3,417,019 | 12/1968 | Beyer | 252/62.1 |
| 3,515,656 | 6/1970 | Huang et al. | 260/86.7 |
| 3,623,986 | 11/1971 | Machida et al. | 252/62.1 |
| 3,639,243 | 2/1972 | Okuno et al. | 252/62.1 L |
| 3,657,130 | 4/1972 | Machida | 252/62.1 L |
| 3,668,127 | 6/1972 | Machida et al. | 252/62.1 |
| 3,671,646 | 6/1972 | Kurita et al. | 252/62.1 |
| 3,689,260 | 9/1972 | Honjo et al. | 252/62.1 |
| 3,776,757 | 12/1973 | Eastman et al. | 252/62.1 L |

*Primary Examiner*—George F. Lesmes
*Assistant Examiner*—R. Eugene Varndell, Jr.
*Attorney, Agent, or Firm*—Craig & Antonelli

[57] ABSTRACT

A liquid developer for electro photography which comprises a coloring agent, a coating agent, a resistivity controlling agent and a carrier liquid which disperses or dissolves the said three agents is suitable for providing high reproducibility of images when at least one of the following copolymers are used as said coating agent:

(a) Copolymer of an acrylic acid compound represented by the following general formula (i) and a para-alkylstyrene represented by the following general formula (ii):

(i)

(wherein $R_1$ is hydrogen or an alkyl group of 1–6 carbon atoms and $R_2$ is hydrogen or $C_mH_pX_q$ wherein $m=1\text{-}6$ and $p+q=2m+1$ or $p+q=m-1$ and X is a halogen, amino group, secondary or tertiary amino group having an alkyl group of 1–4 carbon atoms, nitro group, cyano group or hydroxyl group)

(ii)

(wherein $R_3$ is an alkyl group of 2–18 carbon atoms).

(b) Copolymer obtained by polymerizing at least one member selected from the para-alkylstyrene represented by said general formula (ii), other polymerizable vinyl monomer and a polymerizable polymer and at least one member selected from an acrylic acid compound having an ether bond and represented by the following general formula (iii):

(iii)

(wherein $R_4$ is hydrogen or an alkyl group of 1–6 carbon atoms and $R_5$ is

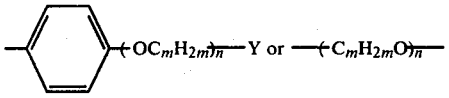

$C_lH_{2l+1}$ wherein Y is hydrogen or hydroxyl group, m is 1–6, n is 1–30 and l is 0–18) and (c) Copolymer obtained by polymerizing at least one acrylic acid compounds selected from those of said general formulas (i) and (iii), the para-alkylstyrene represented by the general formula (ii) and an acrylic acid compound represented by the following general formula (iv):

$$CH_2{=}\underset{\underset{R_6}{|}}{C}{-}COOR_7 \qquad \text{(iv)}$$

(wherein $R_6$ is hydrogen or an alkyl group of 1–6 carbon atoms and $R_7$ is an alkyl group of 1–18 carbon atoms).

30 Claims, 1 Drawing Figure

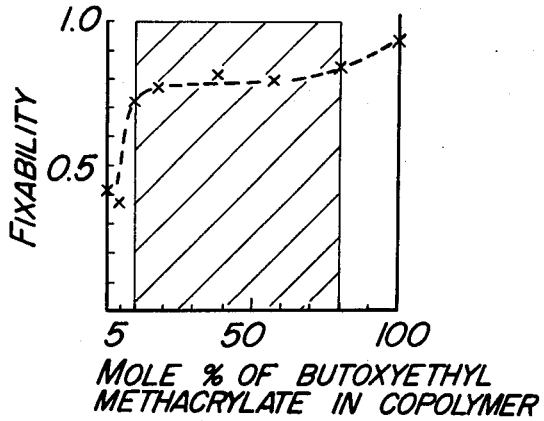
1.0
0.5
FIXABILITY
5
50
100
MOLE % OF BUTOXYETHYL
METHACRYLATE IN COPOLYMER

LIQUID DEVELOPER FOR ELECTRO PHOTOGRAPHY

There are two developing processes in electro photography, namely, dry developing method and wet developing method. The latter wet developing process is much superior to the dry developing process in reproducibility of images (image characteristic) such as gradation. Especially, there are remarkable differences in reproducibility in color images.

Many liquid developers have been proposed for the wet developing process and fundamentally all of them comprise a coloring agent, a coating agent, a resistivity controlling agent and a carrier liquid. Among these components, the coating agent is one of the most important components for image characteristics and properties of the developer. Conventionally employed coating agents are natural rubber, synthetic rubbers such as acrylic rubber, butyl rubber, styrene-butadiene rubber, polyisobutylene rubber, etc., natural resins such as rosin, asphalt, etc., synthetic resins such as alkyd resin or vegetable oil.

However, very few of them satisfy all of the requirements such as fixability, color balance, color tone, hue, and luster and most of them cause tailing of image and fog. For overcoming the tailing and fog, use of additives such as metallic soaps has been proposed. However, according to the inventors' research, amount of such additives as metallic soaps which are strong in polarity should be as low as possible because small amount is very effective for storage stability of the liquid developer and over-printing for obtaining color image, namely, in the case of repeating the development several times per one photoconductive paper (for example ZnO paper).

Regarding the fixability, conventionally, fixability to photoconductive paper (e.g., ZnO paper), has been considered important, but when over-printing is conducted in preparation of color images, not only the fixability between photoconductive paper (e.g., ZnO paper) and developing powders, but also that between the developing powders per se is a very important. Furthermore, with reference to dispersibility, generally it is preferred to use coating agents having a high affinity to carrier liquid used, but many of the conventional coating agents are considerably low in affinity to isoparaffinic hydrocarbons which are favorable in safety and rapid drying ability. Therefore, these coating agents have such defects as low dispersibility and easy aggregation in preparation of liquid developer.

The present invention has been accomplished taking the above matters into consideration.

An object of the present invention is to provide a liquid developer suitable for reproduction of images, especially reproduction of color images.

The second object of the present invention is to provide a liquid developer excellent in fixability.

The third object is to provide a liquid developer capable of reproducing distinct color images excellent in luster.

The fourth object of the present invention is to provide a liquid developer excellent in dispersibility of developer powders.

The fifth object of the present invention is to provide a liquid developer excellent in storage stability and safety.

Other objects will be apparent from the following description.

The accompanying drawing is a graph which shows fixability and storage stability of the liquid developer of one embodiment of the present invention.

The present invention is characterized in that in a liquid developer for electrostatic photography which comprises a coloring agent, a coating agent, a resistivity controlling agent and a carrier liquid which disperses or dissolve said three agents, at least one of the following copolymers (a)-(c) are used as said coating agent:

(a) Copolymer of an acrylic acid compound represented by the following general formula (i) and a para-alkylstyrene represented by the following general formula (ii):

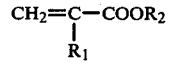

(i)

(wherein $R_1$ is hydrogen or an alkyl group of 1-6 carbon atoms and $R_2$ is hydrogen or $C_mH_pX_q$ wherein $m=1-6$ and $p+q=2m+1$ or $p+q=m-1$ and X is a halogen, amino group, secondary or tertiary amino group having an alkyl group of 1-4 carbon atoms, nitro group, cyano group or hydroxyl group)

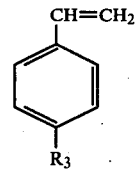

(ii)

(wherein $R_3$ is an alkyl group of 2-18 carbon atoms).

(b) Copolymer obtained by polymerizing at least one member selected from the para-alkylstyrene represented by said general formula (ii), other polymerizable vinyl monomer and a polymerizable polymer and at least one member selected from an acrylic acid compound having an ether bond and represented by the following general formula (iii):

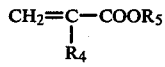

(iii)

(wherein $R_4$ is hydrogen or an alkyl group of 1-6 carbon atoms and $R_5$ is

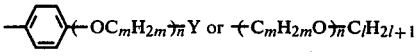

wherein Y is hydrogen or hydroxyl group, m is 1-6, n is 1-30 and l is 0-18) and (c) Copolymer obtained by polymerizing at least one acrylic acid compounds selected from those of said general formulas (i) and (iii), the para-alkylstyrene represented by the general formula (ii) and an acrylic acid compound represented by the following general formula (iv):

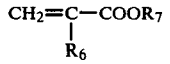

(iv)

(wherein $R_6$ is hydrogen or an alkyl group of 1–6 carbon atoms and $R_7$ is an alkyl group of 1–18 carbon atoms).

As the acrylic acid compounds represented by the general formula (i) which are used in copolymer (a) in the present invention, at least one of the following compounds are used: acrylic acid, methacrylic acid, monofluoroethyl acrylate, monofluoroethyl methacrylate, 2-fluoroethyl acrylate, 2-fluoroethyl methacrylate, 3-chloropropyl acrylate, 2,3-dichloropropyl acrylate, 2,3-dichloropropyl methacrylate, 1,3-dichloro-2-propyl acrylate, 2-bromoethyl acrylate, 3-bromopropyl acrylate, 3-bromopropyl methacrylate, 1-bromo-2-propyl acrylate, 2,3-dibromopropyl acrylate, 2,3-dibromopropyl methacrylate, 2-nitro-1-ethyl acrylate, 2-nitro-1-ethyl methacrylate, 2-nitro-1-propyl acrylate, 2-nitro-1-propyl methacrylate, 2-nitro-1-butyl acrylate, 2-methyl-2-nitro-1-propyl acrylate, 2-methyl-2-nitro-1-propyl methacrylate, cyanmethyl acrylate, cyanmethyl methacrylate, 1-cyanethyl acrylate, 1-cyanethyl methacrylate, 2-cyanethyl acrylate, 2-cyan-2-propyl acrylate, 2-N,N-dimethylaminoethyl acrylate, 2-N,N-dimethylaminoethyl methacrylate, 2-N,N-diethylaminoethyl acrylate, 2-N,N-dimethylaminoethyl methacrylate, 2-N,N-dibutylaminoethyl acrylate, 2-N,N-dibutylaminoethyl methacrylate, 3-N,N-diethylaminopropyl acrylate, 3-N,N-dimethylaminopropyl methacrylate, 2-N,N-dibutylaminopropyl acrylate, 3-N,N-dibutylaminopropyl acrylate, p-chlorophenyl acrylate, p-chlorophenyl methacrylate, 2,4-dichlorophenyl acrylate, 2-N-dichlorophenyl methacrylate, 2-phenoxyethyl acrylate, 2-phenoxyethyl methacrylate, pentachlorophenyl acrylate, pentachlorophenyl methacrylate, o-nitrophenyl acrylate, o-nitrophenyl methacrylate, p-nitrophenyl acrylate, p-nitrophenyl methacrylate, 2,4,6-trinitrophenyl acrylate, 2,4,6-trinitrophenyl methacrylate, etc.

The amount of (i) introduced into the copolymer may be 3–90 mole %, preferably 5–30 mole %. When the amount is more than 90 mole %, dispersibility is decreased and when less than 3 mole %, sufficient improvement in fixability and color density cannot be obtained.

The reason for restriction of $R_1$ in the general formula (i) to hydrogen or an alkyl group of 1–6 carbon atoms is that these compounds can be easily obtained. The reason for restrictions of $R_2$ to hydrogen or $C_mH_pX_q$ and X to a halogen, amino group, secondary or tertiary amino groups, nitro group, cyano group or hydroxyl group is that improvements in fixability and color density are favorably influenced in view of affinity to coloring agent and paper to be copied.

The reason for introducing a para-alkylstyrene of the general formula (ii) as one component of the coating agent is as follows. That is, as compared with the single use of the compound of the general formula (i), dispersibility and storage stability are further improved. Especially, affinity to isoparaffinic hydrocarbons which are practically used as carrier liquid is excellent and no precipitation is caused for a long period of time.

There is no special limitation in the amount of said para-alkylstyrene introduced into the coating agent (copolymer). Generally, the object of the present invention may be attained when it is introduced in an amount of 10–95 mole %, preferably 20–80 mole %. In general, with decrease in the amount of the paraalkylstyrene, dispersibility decreases and brightness of color is reduced and with increase in the amount, the dispersibility increases and brightness of color is apt to increase. The alkyl group represented by $R_3$ causes reduction in dispersibility when carbon number is 1 and causes increase in dispersibility with increase in the carbon number, but too many carbon number has an adverse effect on luster. Therefore, an alkyl group of 2–18 carbon number is preferred. As the para-alkylstyrene used in the present invention, at least one of the following compounds may be used. That is, para-ethylstyrene, para-propylstyrene, para-n-butylstyrene, para-isobutylstyrene, para-tertiary butyl-styrene, para-octylstyrene, para-laurylstyrene, para-stearylstyrene etc. Among them, para-tertiary butylstyrene is the most effective in luster, dispersibility and availability.

Examples of acrylic acid compounds having ether bond, which is represented by the general formula (iii) and which is used in copolymer (b) are ethylene glycol monoacrylate, ethylene glycol monomethacrylate, ethylene glycolphenyl acrylate, ethylene glycol phenyl methacrylate, 2-methoxyethyl acrylate, 2-methoxyethyl methacrylate, 2-ethoxyethyl acrylate, 2-ethoxyethyl methacrylate, 2-butoxyethyl acrylate, 2-butoxyethyl methacrylate, 3-methoxy propyl acrylate, 3-ethoxypropyl acrylate, etc.

Limitations of m to 1–6, n to 1–30 and $l$ to 0 or 1–18 in $R_5$ in the general formula (iii) are for improvement in fixability and color density. Outside these ranges the improvement cannot be fully attained. In general, the greater l, m and n within said ranges are more advantageous in dispersibility, but less advantageous in fixability.

In the present invention, copolymer including at least one of the acrylic acid compounds of the general formula (iii) are used as essential component of the coating agent. That is, in the present invention, the copolymers of said acrylic acid compound with, for example, the following materials may also be used. That is, vinyl monomers other than said acrylic acid compounds such as styrene, vinyltoluene, p-tert-butylstyrene, vinyl acetate, vinyl chloride, acrylic acid, methacrylic acid, acrylic alkyl esters, methacrylic alkyl esters, methacrylic glycidyl ester, methacrylic hydroxyethyl ester or graft polymerizable polymers such as unsaturated alkyd, styrene-butadiene rubber, butadiene rubber, ethylenepropylene polymer, cyclized rubber, etc.

When said vinyl monomer or graft polymerizable polymer is used in combination with said acrylic acid compound, amount of said monomer or polymer introduced is effectively not more than 95 mole % (said acrylic acid compound at least 5 mole %) and preferably 10–80 mole % (said acrylic acid compound 80–10 mole %) from the viewpoint of dispersibility and storage stability. When the introduction amount of said polymerizable monomer or polymer is too large, fixability and color density, especially the latter is lowered.

The copolymers of acrylic acid compounds represented by the general formula (iv) and compounds represented by the general formula (i) and (ii) in copolymer (c) are especially effective for improving fixability between developer powders per se and color density. Thus, the copolymers exhibit the effect in developments of many times for reproduction of color images. Amount of said acrylic acid compound introduced into the coating agent may vary in considerably wide range, but an amount of 5–90 mole % can sufficiently accomplish the object of the present invention. However, the range of 5–90 mole % is especially preferred. When the introduction amount is too small, fixability, color density and developing speed are adversely affected and when too large, dispersibility and storage stability are reduced and some of the acrylic acid compounds give adverse effect on fixability, too. This acrylic acid compound having weak polarity is considered to serve as an intermediary for increasing affinity between para-alkylstyrene of the general formula (ii) and the acrylic acid compound of the general formula (i) having a strong polarity in the copolymer and affinity between the para-alkylstyrene and the coloring agent and the carrier liquid. Carbon number of alkyl group of $R_6$ in the general formula (iv) is limited to 1–6 because such monomer can be easily obtained. Furthermore, carbon number of alkyl group of $R_7$ is limited to 1–18 for the same reason as mentioned above and carbon number of 4–18 may be widely used from the viewpoint of dispersibility.

Examples of the acrylic acid compound represented by the general formula (iv) are as follows, methyl acrylate, methyl methacrylate, ethyl acrylate, ethyl methacrylate, n-propyl acrylate, n-propyl methacrylate, iso-propyl acrylate, iso-propyl methacrylate, n-butyl acrylate, n-butyl methacrylate, iso-butyl acrylate, iso-butyl methacrylate, tert-butyl acrylate, tert-butyl methacrylate, n-amyl acrylate, n-amyl methacrylate, 3-pentyl acrylate, 3-pentyl methacrylate, 2-methyl-1-butyl acrylate, 2-methyl-1-butyl methacrylate, 3-methyl-1-butyl acrylate, n-hexyl acrylate, n-hexyl methacrylate, 2-methyl-1-pentyl acrylate, 2-ethyl-1-butyl acrylate, 4-methyl-2-pentyl acrylate, n-heptylacrylate, 2-heptyl acrylate, n-octyl acrylate, n-octyl methacrylate, 2-ethyl-1-hexyl acrylate, 2-ethyl-1-hexyl methacrylate, 2-octyl-acrylate, n-nonyl acrylate, n-decyl acrylate, n-decyl methacrylate, 5-ethyl-2-nonyl acrylate, n-dodecyl acrylate, n-dodecyl methacrylate, n-tetradecyl acrylate, n-tetradecyl methacrylate, 2-methyl-7-ethyl-4-undecyl acrylate, n-hexadecyl acrylate, n-hexadecyl methacrylate, n-octadecyl acrylate, n-octadecyl methacrylate, cyclohexyl acrylate, cyclohexyl methacrylate, 2-methyl cyclohexyl acrylate, 2-methylcyclohexyl methacrylate, 3-methylcyclohexyl acrylate, 4-methylcyclohexyl acrylate, 3,3,5-trimethylcyclohexyl acrylate, 3,3,5-trimethylcyclohexyl methacrylate, 4-tert-amylcyclohexyl acrylate, 4-cyclohexylcyclohexyl acrylate, 4-cyclohexylcyclohexyl methacrylate, 2,4-diamylcyclohexyl acrylate, hydroabietyl acrylate, phenyl acylate, phenyl methacylate, o-toluyl acrylate, m-methylphenyl acrylate, benzyl acrylate, benzyl methacrylate, 1-phenylethyl acrylate, 1-phenylethyl methacrylate, 2-phenylethyl acrylate, 2-phenylethyl methacrylate, p-tert-butylphenyl acrylate, p-tert-amylphenyl acrylate, p-cyclohexylphenyl acrylate, p-cyclohexylphenyl methacrylate, α-naphthyl acrylate, β-naphthyl acrylate, etc.

The molecular weight of polymers of copolymers of the coating agents (a)–(b) of the present invention is not specially limitative. According to the usual polymerization method, those of $5\times10^2$–$10^5$ in molecular weight can be easily obtained and it has been confirmed that the object of the present invention can be fully attained by those having a molecular weight within said range. There is the tendency that when the molecular weight is less than $5\times10^2$, fixability decreases and when more than $10^5$, dispersibility and overprint usability decrease.

The coating agent in the present invention may be prepared by any methods and there is no limitation. That is, regardless of the polymerization methods, it is sufficient that homopolymers or copolymers containing said acrylic acid compound as polymer component are resultantly obtained. For example, solution polymerization or suspension polymerization may be employed as the polymerization method. An example of preparation of the coating agent is explained below with reference to solution polymerization method.

As a solvent for reaction system, at least one of aromatic solvents such as benzene, toluene, xylene, etc., aliphatic hydrocarbons such as n-hexane, n-pentane, isoparaffinic hydrocarbons, etc. or halogenated hydrocarbons such as dichloroethane, chloroform, etc. may be used. Furthermore, at least one of alcohols such as ethyl alcohol, n-propyl alcohol, isopropyl alcohol, etc., ketones such as acetone, methyl ethylketone, etc., glycols such as ethylene glycol, diethylene glycol, etc. or mercaptans may be used in combination with said solvent for control of reaction. Among said solvents, the isoparaffinic hydrocarbons are also suitable as carrier liquid of the present developer and hence when the isoparaffinic hydrocarbons are used as the solvent, the developer of the present invention can be directly obtained by adding coloring agent and resistivity controlling agent to reaction solution after polymerization. As a reaction catalyst, an azo compound such as azobisisobutyronitrile or a peroxide such as benzoyl peroxide, di-tert-butyl peroxide or lauryl peroxide may be used. In the present invention, as mentioned above, other vinyl monomers and graft polymerizable polymers may be jointly used at polymerization to obtain copolymer.

The term "resistivity controlling agent" used herein refers to, for example, one which contributes to control of charge of powders. For this purpose, for example, soaps of an organic acis such as naphthenic acid, octenoic acid or stearic acid and a polyvalent metal may be used. As the polyvalent metal, those of Groups I, II, III, IV and VII of the Periodic Table and transition metals such as natrium, potassium, calcium, barium, aluminum, manganese, colbalt, nickel, copper, zinc, lead, zirconium, etc. are effective. Besides, organic phosphorus compounds such as triphenyl phosphite and trioctadecyl phosphite, organic tin compounds such as butyltin maleate, dibutyltin oxide, epoxy compounds, organic acid esters of polyhydric alcohol, phenol derivatives of aliphatic compounds, non-ionic surfactants are also useful. These compounds act not only as resistivity controlling agent, but also as dispersibility improving agent, antioxidant or tailing inhibitor.

The carrier liquids used in the present invention are those having relatively high flash point and no toxicity from the point of safety and preferably being excellent in swelling and dissolving action on toners and in drying ability. Those which meet these requirements and which are known now are, for example, isoparaffinic hydrocarbons. Moreover, halogenated hydrocarbons such as trifluoroethane, dichlorodifluoro ethane, and carbon tetrachloride, aliphatic or alicyclic hydrocarbons such as n-oxane, n-pentane, cyclohexane, etc., aromatic hydrocarbons such as benzene, toluene, xylene, etc. and hydrocarbons such as petroleum fractions called naphtha or petroleum ether may also be used.

There is no specific limitation in the coloring agents used in the present invention, but those excellent in transmittance are preferred. Examples of the coloring agents used in the present invention are Lithol Maroon Toner, Alizarine Lake B, Bon Red Toner 5B , Calcium Lithol Toner, Barium Lithol Toner, Pigment Scarlet, Bon Red Toner Y, Lithol Rubine, Brilliant Red Lake R, Lake Red C, Benzidine Yellow, Hansa Yellow, Benzidine Orange, Rhodamine 6G Lake, Rhodamine Toner B, Para Red Toner Light, P, T, A Violet Toner, Peacock Blue Toner, Permanent Peacock Blue, Victoria Blue Toner, Copper Phthalocyanine, Alkali Blue Toner, Malachite Green Toner, Phthalocyanine Green, etc. Furthermore, as black coloring agents, there are Mogul A and Mogul L (Cabot Co., Ltd. in U.S.A.) to which carbon black or black dyes are allowed to adhere.

Among the resistivity controlling agents and the carrier liquids which are combined with the coating agent in the present invention, especially effective combinations are as follows: One is a combination which uses isoparaffinic hydrocarbon as the carrier liquid and the other is a combination which uses polyvalent metal soaps as the resistivity controlling agent. Effects obtained by the former combination are quick drying ability and safety. The quick drying ability is important for not lowering the charging ability of photoconductive paper after development when overprinting is carried out in electrostatic photography. When sufficient quick drying ability is not obtained, charging potential cannot be sufficiently obtained and development of the second and the following colors in over-printing becomes incomplete to result in insufficient hue and color density.

Flash point of the carrier liquid is preferably at least 30° C. in view of safety and only a few carrier liquids meet said safety together with other requirements as carrier liquid. Isoparaffinic hydrocarbons having a boiling point of 130° C. or higher such as Isopar G and Isopar H produced by Esso Co., Shellzole produced by Shell Co. are very useful in this connection.

On the other hand, the latter combination is effective for stabilization of powders, in other words, for formation of preferable charging state. Dispersibility is markedly improved as compared with the case where no resistivity controlling agent is added and excellent images having no tailing and fog can be obtained by suitably selecting kind and amount of polyvalent metallic soaps.

The mixing ratio of the coloring agent and the coating agent may be optionally chosen. The optimum ratio varies depending on the kinds of the coloring agent and the coating agent, but in general the ratio of 100–1600 parts by weight of the latter per 100 parts by weight of the former is suitable.

The amount of the resistivity controlling agent is preferably chosen so that liquid resistivity of developer may be within the range of $10^9$–$10^{12}$ Ωcm when the main purpose is to control the resistivity and charging characteristic in the case of obtaining color images by overprinting may not be decreased. Usually, not more than 5 g of the resistivity controlling agent per 1 l of the carrier liquid is suitable. Taking developing speed and aggregation of powders into consideration, usually the amount of the carrier liquid is suitably 50–1000 parts by weight per one part by weight of coloring agent.

Preparation of the liquid developer of the present invention may be accomplished by various methods using the coloring agent (a), coating agent (b), resistivity controlling agent (c) and carrier liquid (d).

General methods of the preparation will be illustrated below.

(1) (a)–(d) are mixed and homogeneously dispersed by sand mill, ball mill or roll mill to obtain a concentrated developer, which is then diluted with (d).

(2) (a) and (b) are mixed in a suitable solvent and dried and then ground. The resultant powders are dispersed in (d) to which (c) has been added.

(3) (a) and (b) or (a)–(c) are previously mixed and ground and then the powders are dispersed in (d) to which (c) has been added or in (d).

(4) (a) and said acrylic ester or (a) and other polymerizable monomer are added to a solvent and dissolved therein. The resultant solution is added to an aqueous medium to effect suspension polymerization. The resultant powders are separated and dispersed in (d) containing (c).

(5) (a) and said acrylic acid compound or (a) and other polymerizable monomer are added to a solvent to effect solution polymerization. The reaction product is dried and ground and the resultant powders are dispersed in (d) containing (c). In this case, when isoparaffinic hydrocarbons which are also suitable as carrier liquid is used as the solvent, the desired liquid developer can be immediately obtained only by subjecting the resultant solution to ball mill, sand mill or ultrasonic wave.

Of course, the present invention is not limited to said five methods.

Preparation examples of the coating agent used in the present invention and working examples of the present invention which used said coating agent are shown below.

PREPARATION EXAMPLE 1

To totally 200 parts by weight of the charging compositions as shown in the following Table 1 were added 4.5 parts by weight of di-tert-butyl peroxide as a polymerization initiator and 0.2 part by weight of tert-dodecylmercaptan as a chain transfer agent. The resultant solution was added dropwise to 250 parts by weight of Isopar G 250 at 140° C. for 2 hours. Thereafter, this was heated for 5 hours at said temperature to complete the reaction.

Table 1

| Sample No. | Component and Compositions of Coating Agent | |
|---|---|---|
| | Components | Mole % |
| | Butoxyethyl methacrylate | 19 |
| 1 | Hydroxyethyl methacrylate | 5 |
| | Isobutyl methacrylate | 19 |
| | p-tert-Butylstyrene | 57 |
| 2 | Butoxyethyl methacrylate | 5 |
| | Linseed oil modified alkyd | 95 |
| | 3-Methoxybutyl methacrylate | 25 |
| 3 | Isobutyl methacrylate | 10 |
| | Polybutadiene | 65 |
| 4 | Butoxyethyl methacrylate | 90 |
| | Stearyl methacrylate | 10 |
| | Ethoxyethyl methacrylate | 5 |
| 5 | Lauryl methacrylate | 55 |
| | p-tert-Butylstyrene | 40 |
| | Butoxyethyl acrylate | 85 |
| 6 | Glycidyl methacrylate | 5 |
| | p-tert-Butylstyrene | 10 |
| | Hydroxyethyl methacrylate | 5 |
| 7 | Isobutyl methacrylate | 30 |
| | p-tert-Butylstyrene | 65 |
| 8 | Linseed oil modified alkyd resin | 100 |
| 9 | Polybutadiene | 70 |
| | Isobutyl methacrylate | 30 |

PREPARATION EXAMPLE 2

250 g of Isopar G (isoparaffinic hydrocarbon of high boiling point produced by Esso Co.) which was a reactive solvent was charged in a flask and the temperature thereof was elevated to 140° C. while blowing nitrogen gas thereinto. Then, a mixed solution of 150 g of octyl methacrylate, 225 g of p-tert-butylstyrene, 5 mole % of hydroxyethyl methacrylate monomer per the octyl methacrylate, 45 g of di-tert-butyl peroxide as a polymerization initiator and 0.2 g of tert-dodecylmercaptan was added dropwise over a period of 2 hours. After the addition, this was kept at 140° C. and when content of non-volatile matter became more than 36%, the reaction was completed. The reactant Isopar G solution was used as it was as a coating agent of the developer at preparation. The molecular weight of the reactant can be optionally adjusted to the range of $5\times10^2$–$10^5$ depending upon kind and amount of the polymerization catalyst, kind and amount of the chain transferring agent and reaction conditions.

The coating agents prepared in the same manner as in said Preparation Example 2 are enumerated in the following Table 2.

Table 2

| Sample No. | Compositions of coating agent | Molar ratio of the coating agent composition | Molecular* weight | Non-volatile matter (%) | Note |
|---|---|---|---|---|---|
| 1 | Polyisobutyl methacrylate | — | 10,500 | 35.7 | Comparative sample |
| 2 | Poly(isobutyl methacrylate - styrene - glycidyl methacrylate) | 3 : 2 : 0.15 | 9,800 | 38.9 | " |
| 3 | Poly(isobutyl methacrylate - p-tert-butylstyrene - glycidyl methacrylate | " | 15,500 | 36.9 | The present invention |
| 4 | Poly(isobutyl methacrylate-vinyltoluene) | 3 : 2 | 12,400 | 36.2 | Comparative sample |
| 5 | Poly(isobutyl methacrylate - p-tert-butylstyrene - hydroxyethyl methacrylate) | 3 : 2 : 0.15 | 13,200 | 37.9 | The present invention |
| 6 | Poly(lauryl acrylate - p-tert-butylstyrene - hydroxyethyl methacrylate) | 2 : 3 : 0.1 | 22,300 | 31.2 | " |
| 7 | Poly(stearyl methacrylate - vinyltoluene - acetoxyethyl methacrylate | 1 : 4 : 0.05 | 6,900 | 35.4 | The present invention |
| 8 | Poly(isobutyl methacrylate - p-octylstyrene - hydroxypropyl methacrylate) | 4 : 1 : 0.2 | 42,100 | 33.8 | " |

*Measured by VPO method and means values thereof are shown.

EXAMPLE 1

One part by weight of Rhodamine 6G Lake (Fanal Pink SM 4600 produced by BASF Co. in West Germany) as coloring agent (a), 8 parts by weight of copolymers of each sample shown in Table 1 as coating agent (b), 1.8 part by weight of 8% cobalt octenoate (mineral spirit solution) as additive (c) and 50 parts by weight of Isopar G were ground by ball mill for 24 hours and mixed. Two parts by weight of the resultant concentrated developer was diluted with 70 parts by weight of Isopar G to obtain six kinds (Table 1; No. 1–No. 6) of the desired liquid developer for electrostatic photography.

Fixability was examined on Sample Nos. 1–3 of thus obtained liquid developers. First, zinc oxide paper for Hitachi Color Copying Machine GX-201 which used acrylic resin binder was charged with −6 kv and then dipped in the liquid developers obtained above without exposure to allow the developer powders to uniformly adhere thereto and then air-dried. Thereafter, a cellophane tape (scotch taper produced by 3M Co. in U.S.A.) was allowed to stick to the surface to which the developer powders adhered and then the tape was peeled off. Fixability was expressed by ratio of densities of the surface of which the developer powders adhered before and after peeling off the tape. The greater the value is, the better the fixability is. The results are shown in Table 3. For comparison, fixabilities of the developers prepared in the same manner as mentioned above using the monomers of samples No. 7–9 of Table 1 are also shown in Table 3. As is clear from Table 3, the samples No. 1–3 of the present invention had greater fixability than corresponding comparative samples No. 7–9 which employed as coating agent polymers containing no alkyl ether group containing acrylic ester.

Table 3

| Sample No. | Fixability |
|---|---|
| 1 | 0.93 |
| 7 | 0.67 |
| 2 | 0.82 |
| 8 | 0.44 |
| 3 | 0.74 |
| 9 | 0.41 |

EXAMPLE 2

Copolymers in which mixing molar ratio of p-tert-butylstyrene and butoxyethyl methacrylate was changed were prepared in the same manner as in the Preparation Example 1.

Then, liquid developers were prepared in the same manner as in Example 1 using said copolymers as the coating agent and fixability of the developers were measured.

The results are shown in the accompanying drawing. It can be recognized from the drawing that when 10 mole % or more of butoxyethyl methacrylate was used, developers excellent in fixability were obtained. Furthermore, the area of obliqure lines indicates the area where dispersibility of the developer was satisfactory. In this area, the developer was stable for more than 6 months.

EXAMPLE 3

Using the coating agents of sample No. 4–6 in Table 1, three kinds of the objective liquid developers were prepared in accordance with the procedure of Example 1 except that copper phthalocyanine (Heliogen Blue B produced by BASF Co. in West Germany) was used in place of Rhodamine 6G Lake as coloring agent (a).

Fixability of thus obtained three kinds of liquid developer was examined in the following manner. Zinc oxide conductive paper (BS type) produced by Ricoh Co. was charged with −6 kv and exposed imagewise. Then, this was dipped in said liquid developers to accomplish development. As the result, images which exactly corresponded to the original and were not peeled off even when they were rubbed by fingers were obtained.

EXAMPLE 4

Using the coating agents of sample No. 1 and 4 in Table 1, three kinds of the objective liquid developers for cyan, magenta and yellow were prepared in the same manner as of Example 1 except that Benzidine Yellow (SFY 2300 produced by Dainihon Seika K.K.) was used as a yellow pigment. Storage stability of these developers were very excellent.

Color images were copied by Hatachi Color Copying machine GX−201 using said liquid developers of three colors. Fixability of distinct images thus obtained was very excellent as in Examples 1 and 2. Moreover, these developers caused no troubles during storage of more than 3 months and has good storage stability.

The liquid developers of the present invention mentioned above are effective as liquid developer for all wet type electrostatic photography. Of course, they can be used for both direct and transfer type photographies. In the case of the transfer type, not only ordinary paper, but also synthetic resin films may be used as the copying materials.

EXAMPLE 5

The following developers were prepared using the coating agents of samples No. 1, 2, 3 and 5 in Table 2. To 20 g of copper phthalocyanine (cyanine Blue LC produced by Dainihon Ink Co.) were added 80 g of each of said coating agents as a resin component, 22 g of 8% manganese octenoate (mineral spirit solution) as an additive and 60 ml of Isopar G as carrier liquid and these were ground and milled by ball mill for 10 hours. 0.2 g of thus obtained concentrated developers were diluted with 100 ml of Isopar G and dispersibility of each developer was examined. Although the dispersibility can be measured by measuring sedimentation velocity by contrifugation, it was conveniently measured here by measuring absorbance of solution. The results are shown in Table 4 where the dispersibility was expressed by difference in absorbances of 525 mμ and 650 mμ. The greater the difference is, the better the dispersibility is. That is, it is recognized that samples No. 3−C and 5−C were excellent in dispersibility and storage stability.

EXAMPLE 6

Using the coating agents of samples No. 4, 5 and 6 in Table 2, developers shown in Table 5 were prepared. Fixability and dispersibility thereof are shown in Table 6. The fixability was measured as follows: That is, using zinc oxide conductive papers for Hatachi Color copying machine GX 201 these papers were charged with a voltage of −6 kv and then over-printed with each developer of yellow (Y), magneta (M) and cyan (C) to obtain each color of Y, M and C and red (R), green (G) and blue (B) which were over-printed parts. Fixability between the developer and the conductive paper was examined on said Y, M and C and fixability between the toners was examined on said R, G and B. That is, peeling off test was conducted using Cello-Tape (No. 810 produced by Sumitomo 3M Co.) and the fixability was expressed by the ratio (Ra) of color density before and after peeling off of Cello-Tape. The greater the value is, the better the fixability is. The color density was measured by Mcbeth densitometer manufactured by Macbeth Co. The dispersibility was expressed by difference in absorbance of 525 mμ and 650 mμ in the case of cyan as in Example 5, in absorbances of 445 mμ and 560 mμ in the case of magneta and in absorbances of 700 mμ and 450 mμ in the case of yellow. From Table 6, it is clear that developers No. 5′ and No. 6′ containing the para-tert-butyl styrene and the acrylic ester derivative having polar group were improved in fixability and dispersibility as compared with developer No. 4′ which was for comparison.

EXAMPLE 7

Using the coating agents of samples No. 7 and No. 8 in Table 2, developers were prepared in the same manner as in Example 5 except that 10 parts by weight of carbon black (Mogul L produced by Cabot Co., Ltd.) was used in place of copper phthalocyanin as the coloring agent and 20 g of concentrated developer was diluted with 1 l of Isopar H. Then, the conductive paper used in Example 6 was charged with −5.5 kv and exposed through an original of intermediate tone and thereafter developed with said diluted developers to obtain excellent copied images exactly corresponding to the original with both developers.

Table 4

| Sample No.* | Dispersibility A525–A650 | Dispersibility Evaluation** | Storage stability |
|---|---|---|---|
| Comparative Sample 1 - C | 0.33 | X | — |
| Comparative Sample 2 - C | 0.40 | Δ | Separated into two layers after lapse of one week |
| Sample of the present invention 3 - C | 0.64 | o | Stable for more than one month |
| Sample of the present invention 5 - C | 0.62 | o | " |

*The numerals in sample No. correspond to those in Table 2.
**"X" means inferior dispersibility.
"Δ" means somewhat inferior dispersibility.
"o" means excellent dispersibility.

Table 5

| Sample No. | Coloring agent (one part by weight) | Coating agent* (8 parts by weight) | Additives | Note** |
|---|---|---|---|---|
| No. 4′ | Benzidine Yellow (Y) Rhodamine 6G Lake (M) Copper Phthalocyane (C) | Sample No. 4 | 12% Zirconium octenoate (one part by weight) 8% Cobalt naphthenate (0.2 part by weight) | Comparative sample |

Table 5-continued

| Sample No. | Coloring agent (one part by weight) | Coating agent* (8 parts by weight) | Additives | Note** |
|---|---|---|---|---|
| No. 5' | " | Sample No. 5 | " | Sample of the present invention |
| No. 6' | " | Sample No. 6 | " | " |

*Refer to Table 2
**Prepared by attritor MA-01B manufactured by Daiwa Plastic Co.

Table 6

| | Fixability | | | | | | | | | Dispersibility | | |
|---|---|---|---|---|---|---|---|---|---|---|---|---|
| | | | | R | | G | | B | | | | |
| Sample No.* | Y | M | C | Y | M | Y | C | M | C | Y | M | C |
| 4' (Comparative sample) | 0.30 | 0.49 | 0.62 | 0.43 | 0.34 | 0.47 | 0.28 | 0.63 | 0.43 | 0.46 | 0.51 | 0.44 |
| 5' (Sample of the present invention) | 0.50 | 0.22 | 0.82 | 0.59 | 0.62 | 0.63 | 0.64 | 0.77 | 0.65 | 0.73 | 0.74 | 0.82 |
| 6' (Sample of the present invention) | 0.55 | 0.80 | 0.81 | 0.57 | 0.65 | 0.63 | 0.72 | 0.90 | 0.85 | 0.78 | 0.76 | 0.87 |

*The numbers in sample No. correspond to those in Table 2
**R: red, G: green, B: Blue, Y: yellow, M: magenta, C: cyan

What is claimed is:

1. In a liquid developer for electrophotography containing a coloring agent, a coating agent, a resistivity controllling agent and a carrier liquid for dispersing or dissolving said coloring agent, coating agent and resistivity controlling agent, the improvement wherein the coating agent comprises:

a copolymer obtained by polymerizing (a) acrylic acid components selected from the group consisting of compounds represented by the general formula:

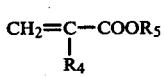

(iii)

and mixtures of (iii) with compounds represented by the general formula

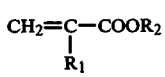

(i), with (b) a para-alkylstyrene represented by the general formula

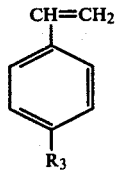

(ii), and with (c) an acrylic acid compound represented by the general formula

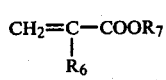

(iv)

wherein $R_1$ is a hydrogen or methyl, $R_2$ is hydrogen, $R_3$ is an alkyl group of 12-18 carbon atoms, $R_4$ is hydrogen or methyl, $R_5$ is $C_mH_{2m}O—ClH_{2l+1}$ wherein m is 1-3 and l is 1-4, $R_6$ is hydrogen or methyl and $R_7$ is an alkyl group of 1-18 carbon atoms.

2. In a process of producing images by electrostatic photography wherein a high voltage charge is applied to a photoconductive base, the charged base exposed, and the resultant image on the base developed by overprinting the exposed image-bearing base with a liquid developer containing a coloring agent, a coating agent, a resistivity controlling agent, and carrier liquid, the improvement which comprises over-printing the exposed base with a liquid developer containing a coating agent in accordance with claim 1.

3. A liquid developer according to claim 1, wherein, in the copolymer used as the coating agent, the acrylic acid compound of formula (i) and the para-alkylstyrene of formula (ii), are present in amounts between about 30-90 mole % and between about 10-95 mole % in the copolymer; respectively, and the acrylic acid compound of formula (iii) is present in an amount between 80-10 mole %.

4. A liquid developer for electro photography according to claim 1, wherein the para-alkylstyrene represented by the general formula (ii) is para-tert-butylstyrene.

5. A liquid developer for electro photography according to claim 1, wherein the acrylic acid compound represented by the general formula (iii) is butoxyethyl methacrylate.

6. A liquid developer according to claim 1, wherein said carrier liquid is selected from the group consisting of aliphatic, alicyclic, aromatic, halogenated and isoparaffinic hydrocarbons.

7. A liquid developer according to claim 1, wherein said carrier liquid is an isoparaffinic hydrocarbon.

8. A liquid developer according to claim 1, wherein said coloring agent comprises a coloring agent selected from the group consisting of Lithol Maroon Toner, Alizarine Lake B, Bon Red Toner 5B, Calcium Lithol Toner, Barium Lithol Toner, Pigment Scarlet, Bon Red Roner Y, Lithol Rubine, Brilliant Red Lake R, Lake Red C, Benzidine Yellow, Hansa Yellow, Benzidine Orange, Rhodamine 6G Lake, Rhodamine Toner B, Para Red Toner Light, P, T, A Violet Toner, Peacock Blue Toner, Permanent Peacock Blue, Victoria Blue Toner, Copper Phthalocyanine, Alkali Blue Toner, Malachite Green Toner, Phthalocyanine Green, Mogul A, Mogul L and Carbon Black.

9. A liquid developer according to claim 1, wherein the acrylic acid compound represented by the general formula (i) is contained in an amount of 3–90 mole % in the copolymer.

10. A liquid developer according to claim 1, wherein the acrylic acid compound represented by the general formula (iv) is contained in an amount of between about 5–90 mole % in the copolymer.

11. A liquid developer according to claim 1, wherein said coating agent is present in an amount ranging between 100–1600 parts by weight per 100 parts by weight of said coloring agent, said resistivity controlling agent is present in an amount sufficient to provide a liquid resistivity of the developer within the range of $10^9$–$10^{12}$ Ω cm and said carrier liquid is present in an amount ranging between 50–1000 parts by weight for each part by weight of said coloring agent.

12. A liquid developer according to claim 1, wherein said coating agent is a copolymer having a molecular weight ranging between $5\times10^2$–$10^5$.

13. A liquid developer according to claim 1, wherein said copolymer comprises the copolymer obtained by the copolymerization of butoxyethyl methacrylate, hydroxyethyl methacrylate, isobutyl methacrylate and p-tert-butylstyrene.

14. A liquid developer according to claim 1 wherein the compound (ii) is p-tert-butylstyrene and the compound (iii) is butoxyethyl methacrylate.

15. A liquid developer according to claim 1 wherein the coating agent comprises a copolymer of an acrylic acid compound (i), a para-alkylstyrene of formula (ii), and an acrylic acid compound (iii).

16. A liquid developer according to claim 1, wherein the coating agent is a copolymer of acrylic compound (iv), acrylic compound (iii), and para-alkylstyrene.

17. A liquid developer according to claim 1, wherein said copolymer is a copolymer consisting essentially of p-tert-butylstyrene, hydroxyethyl methacrylate, and isobutyl methacrylate.

18. A liquid developer according to claim 1, wherein said copolymer is a copolymer consisting essentially of p-tert-butylstyrene, hydroxyethyl methacrylate, and octyl methacrylate.

19. A liquid developer according to claim 1, wherein said copolymer is a copolymer consisting essentially of p-tert-butylstyrene, hydroxyethyl methacrylate, and lauryl acrylate.

20. A liquid developer according to claim 1, wherein said copolymer is a copolymer consisting essentially of p-octylstyrene, hydroxypropyl methacrylate, and isobutyl methacrylate.

21. A liquid developer according to claim 1, wherein said copolymer consists essentially of p-tert-butylstyrene, ethoxyethyl methacrylate, and lauryl methacrylate.

22. A liquid developer according to claim 1, wherein said para-alkylstyrene represented by the general formula (ii) is selected from the group consisting of para-ethylstyrene, para-propylstyrene, para-n-butylstyrene, para-isobutylstyrene, para-tertiary butylstyrene, para-octylstyrene, para-laurylstyrene, and para-stearylstyrene.

23. A liquid developer according to claim 1, wherein said acrylic acid compound represented by the general formula (iii) is selected from the group consisting of 2-methoxyethyl acrylate, 2-methoxyethyl methacrylate, 2-ethoxyethyl acrylate, 2-ethoxyethyl methacrylate, 2-butoxyethyl acrylate, 2-butoxyethyl methacrylate, 3-methoxypropyl acrylate, and 3-ethoxypropyl acrylate.

24. A liquid developer according to claim 1, wherein said acrylic acid compound represented by the general formula (iv) is selected from the group consisting of methyl acrylate, methyl methacrylate, ethyl acrylate, ethyl methacrylate, n-propyl acrylate, n-propyl methacrylate, iso-propyl acrylate, iso-propyl methacrylate, n-butyl acrylate, n-butyl methacrylate, iso-butyl acrylate, iso-butyl methacrylate, tert-butyl acrylate, tert-butyl methacrylate, n-amyl acrylate, n-amyl methacrylate, 3-pentyl acrylate, 3-pentyl methacrylate, 2-methyl-1-butyl acrylate, 2-methyl-1-butyl methacrylate, 3-methyl-1-butyl acrylate, n-hexyl acrylate, n-hexyl methacrylate, 2-methyl-1-pentyl acrylate, 2-ethyl-1-butyl acrylate, 4-methyl-2-pentyl acrylate, n-heptyl acrylate, 2-heptyl acrylate, n-octyl acrylate, n-octyl methacrylate, 2-ethyl-1-hexyl acrylate, 2-ethyl-1-hexyl methacrylate, 2-octyl-acrylate, n-nonyl acrylate, n-decyl acrylate, n-decyl methacrylate, 5-ethyl-2-nonyl acrylate, n-dodecyl acrylate, n-dodecyl methacrylate, n-tetradecyl acrylate, n-tetradecyl methacrylate, 2-methyl-7-ethyl-4-undecyl acrylate, n-hexadecyl acrylate, n-hexadecyl methacrylate, n-octadecyl acrylate, n-octadecyl methacrylate, cyclohexyl acrylate, cyclohexyl methacrylate, 2-methyl cyclohexyl acrylate, 2-methylcyclohexyl methacrylate, 3-methylcyclohexyl acrylate, 4-methylcyclohexyl acrylate, 3,3,5-trimethylcyclohexyl acrylate, 3,3,5-trimethylcyclohexyl methacrylate, 4-tert-amylcyclohexyl acrylate, 4-cyclohexylcyclohexyl acrylate, 4-cyclohexylcyclohexyl methacrylate, and 2,4-diamylcyclohexyl acrylate.

25. A liquid developer for electro photography according to claim 1, wherein the para-alkylstyrene represented by the general formula (ii) is contained in an amount of 20–80 mole % in the copolymer.

26. A liquid developer for electro photography according to claim 25, wherein the para-alkylstyrene is para-tert-butylstyrene.

27. A liquid developer for electro photography according to claim 1, wherein the acrylic acid compound represented by the general formula (iii) is contained in an amount of 10–80 mole % in the copolymer.

28. A liquid developer for electro photography according to claim 27, wherein the acrylic acid compound is butoxyethyl methacrylate.

29. A liquid developer for electrophotography according to claim 1, wherein a soap of an organic acid selected from the group consisting of naphthenic acid, octanoic acid and stearic acid and a polyvalent metal selected from the group consisting of Group I, II, III, IV, VII and transition metals of the Periodic Table is used as the resistivity controlling agent and an isoparaffinic hydrocarbon is used as the carrier liquid.

30. A liquid developer according to claim 29, wherein said soap of an organic acid and a polyvalent metal is selected from the group consisting of zirconium octenoate, cobalt naphthenate and manganese octenoate.

* * * * *